US006179657B1

(12) United States Patent
Murakami et al.

(10) Patent No.: US 6,179,657 B1
(45) **Date of Patent: *Jan. 30, 2001**

(54) WATERPROOF CONNECTOR AND METHOD OF ASSEMBLING THE SAME

(75) Inventors: Takao Murakami; Masaru Fukuda, both of Shizuoka-ken (JP)

(73) Assignee: Yazaki Corporation, Tokyo (JP)

( * ) Notice: Under 35 U.S.C. 154(b), the term of this patent shall be extended for 0 days.

This patent is subject to a terminal disclaimer.

(21) Appl. No.: 09/265,391

(22) Filed: Mar. 10, 1999

(30) Foreign Application Priority Data

Mar. 11, 1998 (JP) ..... 10-60096
Jun. 10, 1998 (JP) ..... 10-162512

(51) Int. Cl.[7] ..... H01R 13/40
(52) U.S. Cl. ..... 439/587
(58) Field of Search ..... 439/598, 589, 439/586, 597, 587, 190, 271

(56) References Cited

U.S. PATENT DOCUMENTS

| | | | | |
|---|---|---|---|---|
| 5,116,236 | | 5/1992 | Colleran et al. | 439/271 |
| 5,197,898 | | 3/1993 | Nagamine | 439/271 |
| 5,645,451 | | 7/1997 | Ohsumi et al. | 439/587 |
| 5,720,629 | * | 2/1998 | Self, Jr. et al. | 439/587 |
| 5,897,396 | * | 4/1999 | Maejima | 439/587 |

FOREIGN PATENT DOCUMENTS

| | | | |
|---|---|---|---|
| 1-213973 | 8/1989 | (JP) | H01R/13/42 |
| 5-65996 | 9/1993 | (JP) | H01R/13/52 |
| 7-22079 | 1/1995 | (JP) | H01R/4/24 |
| WO 9632760 | 10/1996 | (WO) | H01R/13/436 |
| WO 9736346 | 10/1997 | (WO) | H01R/13/52 |

OTHER PUBLICATIONS

European Search Report dated Oct. 4, 1999.

* cited by examiner

*Primary Examiner*—Neil Abrams
*Assistant Examiner*—Michael C. Zarroli
(74) *Attorney, Agent, or Firm*—Finnegan, Henderson, Farabow, Garrett & Dunner, L.L.P.

(57) ABSTRACT

A waterproof connector includes: an inner housing formed with terminal accommodation chambers in which terminals are accommodated; rubber plugs for sealing the electric wires; and an outer housing into which the inner housing is fitted. One wall portion of the outer housing opposing to the terminal accommodation chambers are formed with electric wire insertion and passing holes into which the electric wires are inserted and passed. An inside portion of the one wall portion of the outer housing corresponding to the electric wire insertion and passing holes are formed with rubber plug accommodation recessed portions for the rubber plugs. In the construction, the electric wires that have been inserted and passed through the electric wire insertion and passing holes and the holes of the rubber plugs are connected to the terminals which are accommodated in the terminal accommodation chambers.

4 Claims, 12 Drawing Sheets

WATERPROOF CONNECTOR AND METHOD OF ASSEMBLING THE SAME

BACKGROUND OF THE INVENTION

1. Field of the Invention

The present invention relates to a miniaturized and multipolar waterproof connector which is improved in the waterproofness between a connector housing and a plurality of electric wires having terminals connected thereto, and a method of assembling the same.

2. Description of the Related Art

As this type of waterproof connector there is one which is illustrated in FIG. 1. A connector housing 2 of this waterproof connector 1 has formed therein a plurality of terminal accommodation chambers 3 each of which has formed at its rear portion an electric wire sealing chamber 4 so that the chamber 4 may be communicated therewith. Also, each terminal accommodation chamber 3 has accommodated therein a female terminal 6 having an electric wire connected thereto with the female terminal 6 being engaged with a lance (flexible engaging arm) 7. Further, each terminal accommodation chamber 3 and its corresponding electric wire 5 are sealed by a rubber plug 8 which has been forced into the electric wire sealing chamber 4.

It is to be noted that similar techniques regarding the waterproof connector 1 are disclosed in Japanese Patent Publication Specification No. Hei 5-65996 and Japanese Patent Application Laid-Open No. Hei 1-213973.

However, in the above-described conventional waterproof connector 1, as illustrated in FIG. 2, the diameter L of the electric wire sealing chamber 4 must be made larger than the diameter of the terminal accommodation chamber 3 for the purpose of mold releasing or terminal insertion. Therefore, the terminal-to-terminal pitch X is limited with the result that the connector housing 2 has become large in size. Also, since the rubber plug 8 is exposed from a rear surface side of the connector housing 2 to the outside, the rubber plug 8 is damaged or deformed during high-tension cleaning or due to contact therewith of a machine tool or the like, with the result that a desired level of sealing performance was not obtained.

SUMMARY OF THE INVENTION

The present invention-has been achieved with such points in mind.

It therefore is an object of the present invention to provide a multi-polar waterproof connector which enables the miniaturization of the connector housing as well as the enhancement of the sealability and asseblability thereof and a method of assembling the same.

To achieve the object, according to a first aspect of the present invention, there is provided a waterproof connector comprising: an inner housing having formed therein terminal accommodation chambers in which terminals to which electric wires are to be connected are accommodated; rubber plugs for sealing the electric wires, the rubber plugs having formed therein holes through which the electric wires are inserted and passed; and an outer housing into which the inner housing is fitted, a one wall portion of the outer housing opposing to the terminal accommodation chambers being formed with electric wire insertion and passing holes into which the electric wires are inserted and passed, an inside portion of the one wall portion of the outer housing corresponding to the electric wire insertion and passing holes being formed with rubber plug accommodation recessed portions for accommodating therein the rubber plugs, wherein the electric wires that have been inserted and passed through the electric wire insertion and passing holes and the holes of the rubber plugs are connected to the terminals which are accommodated in the terminal accommodation chambers.

In this waterproof connector, since the diameter of the rubber plug accommodation recessed portions of the outer housing can be minimized irrespective of the size of the terminal accommodation chambers of the inner housing, the terminal-to-terminal's pitch becomes small with the result that it is possible to miniaturize a multipolar connector housing (which is composed of the inner housing and the outer housing). Also, since the rubber plugs are not exposed to the outside from the one wall portion of the outer housing, the degradation of the sealing performance of the rubber plugs due to an external force does not occur, with the result that the reliability on the waterproofness effected with the rubber plugs is enhanced.

According to a second aspect of the present invention, as it depends from the first aspect, there is provided a waterproof connector wherein, a tapered surface is formed on an inlet side of the rubber plug accommodation recessed portion; a tapered surface is formed on each side of the rubber plug; and a rubber plug guiding portion to guide the rubber plug is formed at a position of the inner housing corresponding to the tapered surface of the rubber plug.

In this waterproof connector, the rubber plug guiding portion of the inner housing, the tapered surface on an inlet side of the rubber plug accommodation recessed portion of the outer housing, the tapered surface of the rubber plug, and the electric wire serve and operate as guides, whereby the rubber plug is accommodated reliably in a simple way in the rubber plug accommodation recessed portion of the outer housing. As a result, the reliability on the waterproofness effected with the rubber plugs is further enhanced.

According to a third aspect of the present invention, there is provided a method of assembling a waterproof connector comprising the steps of: accommodating terminals to be connected to electric wires in terminal accommodation chambers formed in an inner housing; inserting and setting rubber plugs for sealing the electric wires in rubber plug accommodation recessed portions formed in an inside portion of a one wall portion of an outer housing; inserting and passing the electric wires into and through electric wire insertion and passing holes formed in the outer housing at the positions of the one wall portion opposed to the terminal accommodation chambers; inserting and passing the electric wires which are passing through the electric wire insertion and passing holes into and through holes which are formed in the rubber plugs; connecting the electric wires passed through the holes of the rubber plugs to the terminals accommodated in the terminal accommodation chambers; and fitting the inner housing into the outer housing.

In this method of assembling a waterproof connector, a small-in-size and multipolar waterproof connector having excellent waterproofness is assembled smoothly in a simple way and in a short time.

According to a fourth aspect of the present invention, there is provided a method of assembling a waterproof connector comprising the steps of: accommodating terminals to be connected to electric wires in terminal accommodation chambers formed in an inner housing; inserting and passing the electric wires into and through electric wire insertion and passing holes formed at the positions of a one wall portion of an outer housing opposing to the terminal accommodation chambers from outside the outer housing to inside the outer housing; inserting and passing the electric wires which are passing through the electric wire insertion and passing holes into and through holes which are formed in rubber plugs; connecting the electric wires passed through the holes of the rubber plugs to the terminals accommodated in the terminal accommodation chambers; drawing the electric wires to the outside of the outer housing in a direction opposite to the direction in which the electric wires are inserted and passed from outside the outer housing to inside the outer housing, as a result, the rubber plugs are inserted and set in the rubber plug accommodation recessed portions which are formed inside the one wall portion of the outer housing; and fitting the inner housing into the outer housing.

In this method of assembling a waterproof connector, simultaneously with the interfitting between the outer housing and inner housing, the rubber plugs are accommodated reliably in a simple way in the rubber plug accommodation recessed portions of the outer housing, with the result that the assemblability of the waterproof connector is further enhanced.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
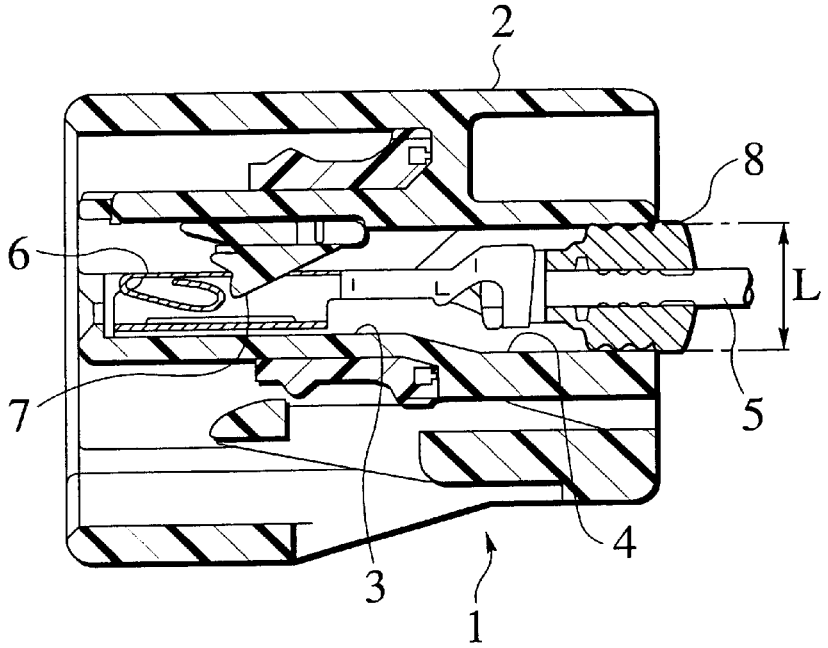
FIG.1 PRIOR ART
FIG. 1 is a sectional view illustrating a conventional example of a waterproof connector.
Figure 2:
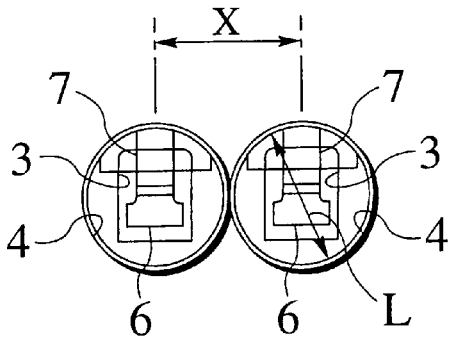
FIG.2 PRIOR ART
FIG. 2 is an explanatory view illustrating the pitch between terminals of the conventional waterproof connector.

There will be detailed below the preferred embodiments of the present invention with reference to the accompanying drawings. Like members are designated by like reference characters.

Figure 3:
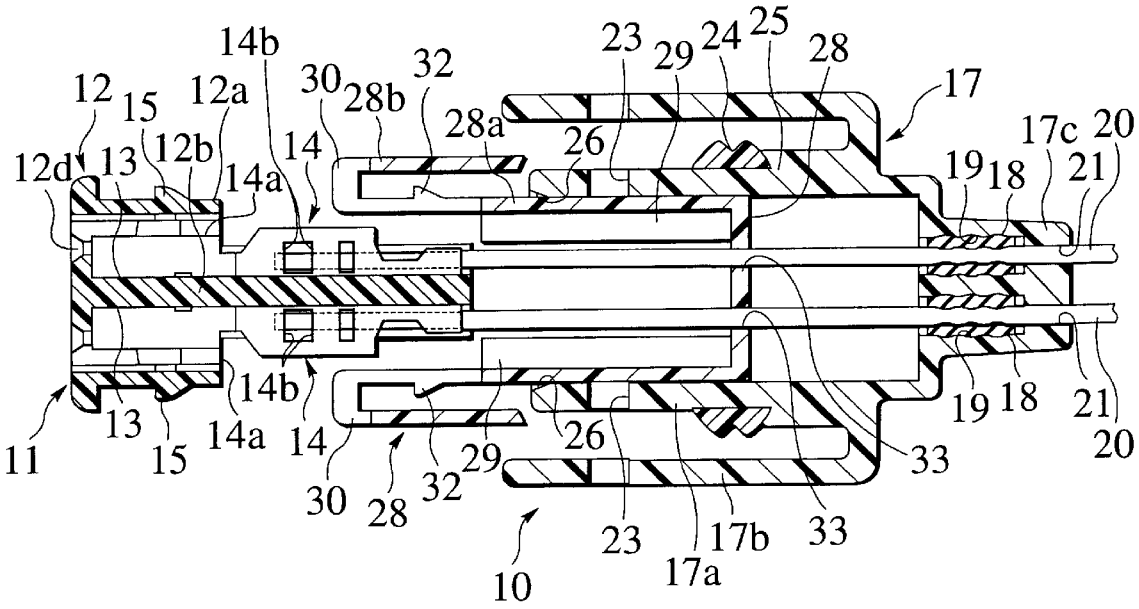
FIG. 3 is a sectional view illustrating a state of a waterproof connector prior to assembly thereof according to an embodiment of the present invention.
Figure 4:
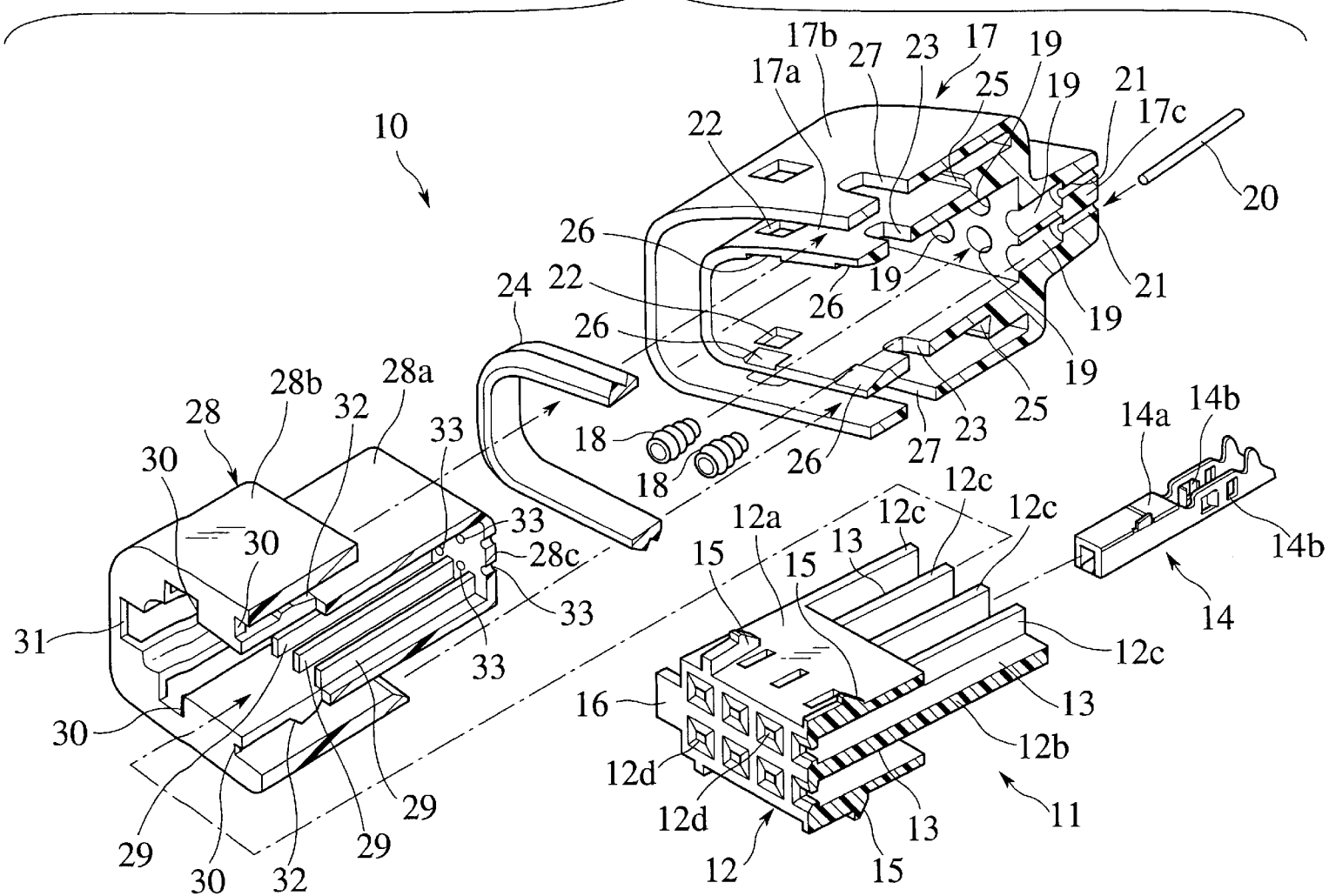
FIG. 4 is a perspective view illustrating partly in section the state of the waterproof connector prior to assembly thereof.
Figure 5:
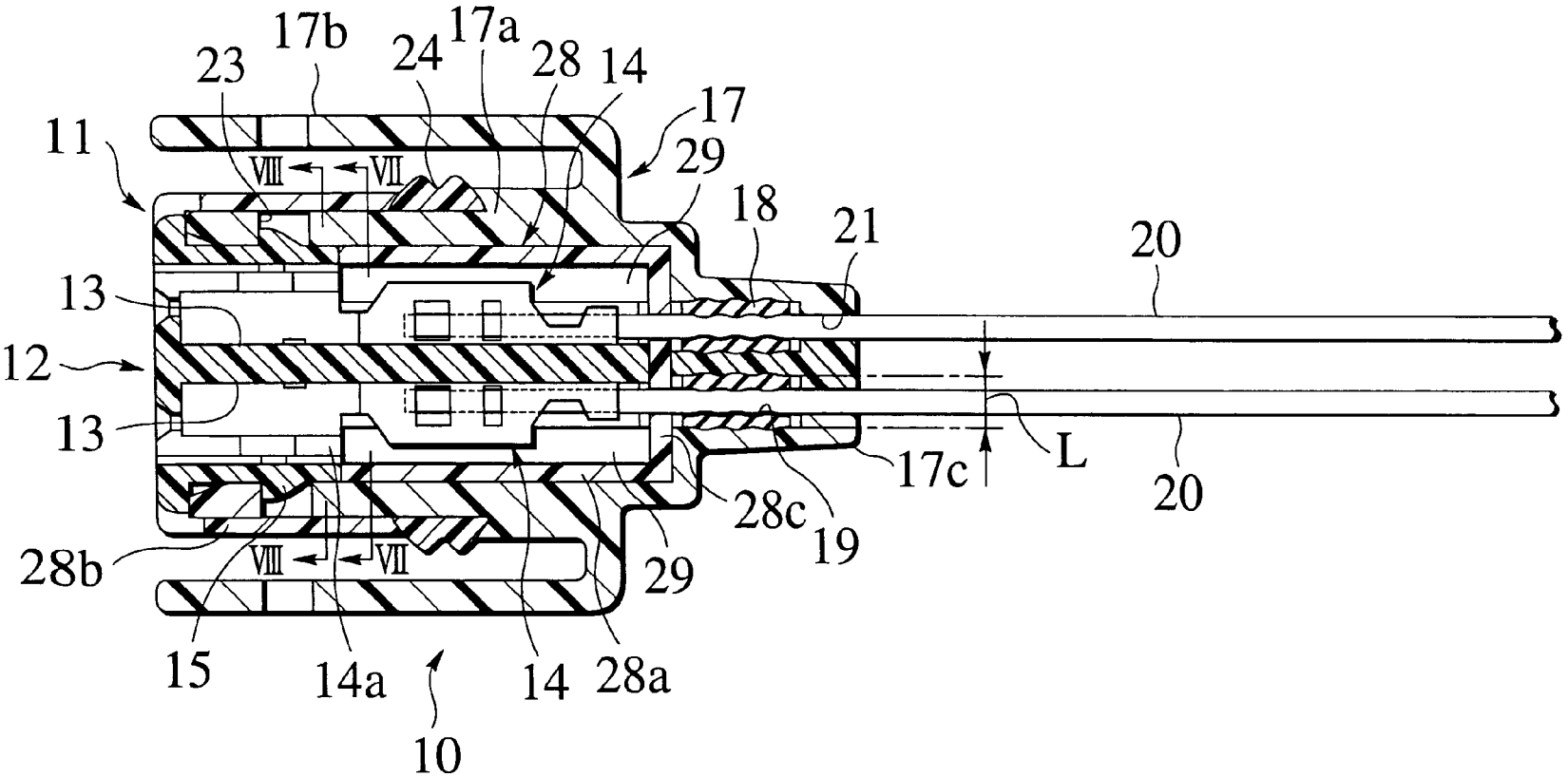
FIG. 5 is a sectional view illustrating a state where the assembly of the waterproof connector is completed.
Figure 6:
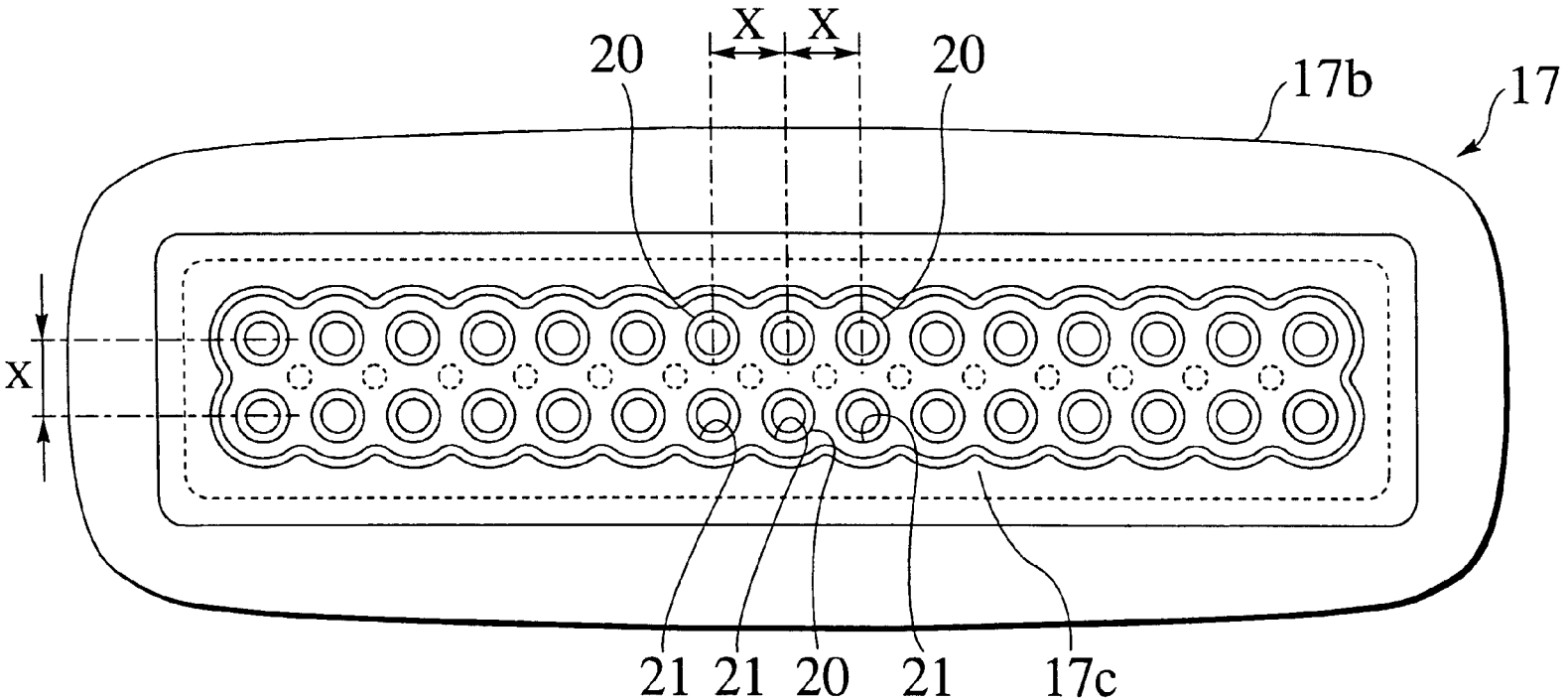
FIG. 6 is a rear surface view illustrating the waterproof connector.
Figure 7:
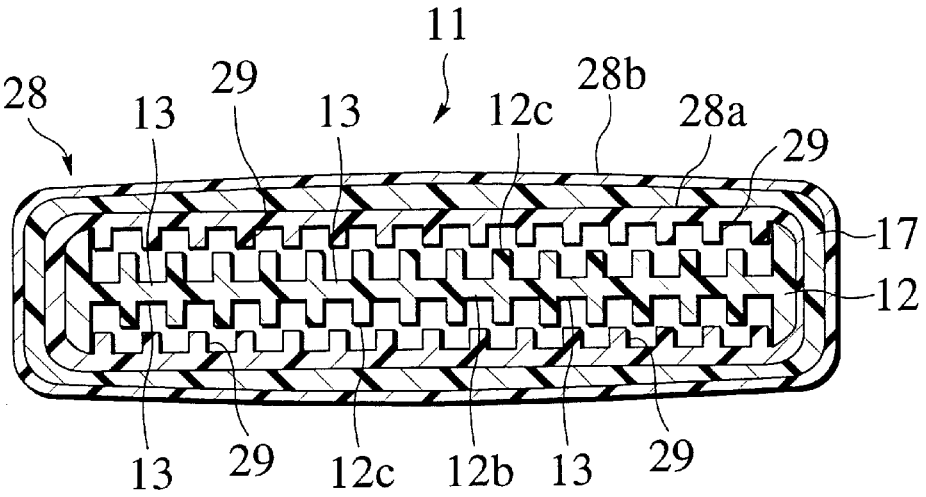
FIG. 7 is a sectional view taken along a line VII—VII of FIG. 5.
Figure 8:
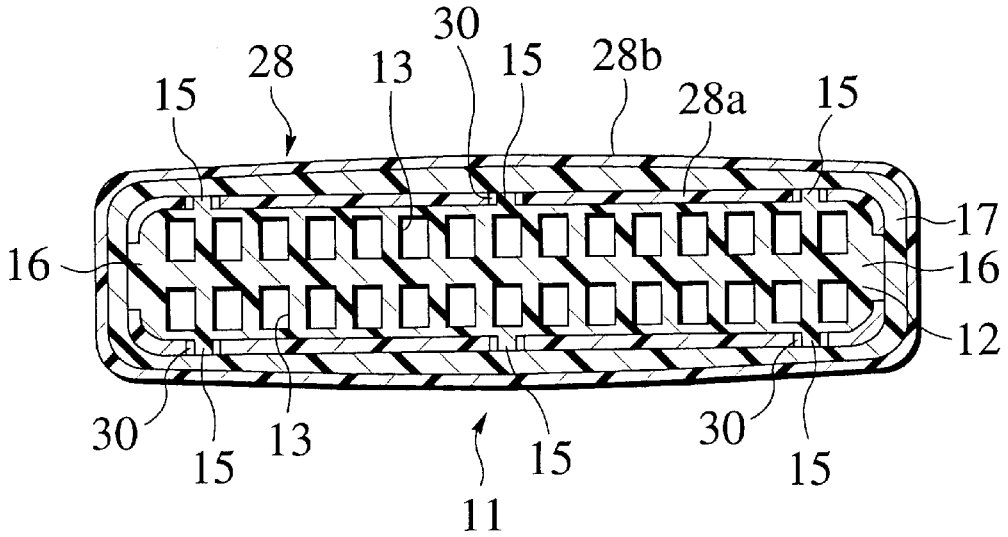
FIG. 8 is a sectional view taken along a line VIII—VIII of FIG. 5.

FIG. 3 is a sectional view illustrating a state of a waterproof connector prior to assembly thereof according to an embodiment of the present invention; FIG. 4 is a perspective view illustrating partly in section the state of the waterproof connector prior to assembly thereof; FIG. 5 is a sectional view illustrating a state where the assembly of the waterproof connector is completed; and FIG. 6 is a rear surface view illustrating the waterproof connector.

As illustrated in FIGS. 3 to 6, a connector housing 11 of a waterproof connector 10 is constituted by an inner housing 12 having integrally formed therein a plurality of terminal accommodation chambers 13 and made of synthetic resin, an outer housing 17 having fitted thereinto the inner housing 12 and made of synthetic resin, and a spacer 28 interposed between the inner housing 12 and outer housing 17 and retaining female terminals (terminals) 14 accommodated in the respective terminal accommodation chambers 13 of the inner housing 12 and made of synthetic resin.

As illustrated in FIGS. 3 and 4, the inner housing 12 has a box portion 12*a* whose upper and lower surfaces are respectively open at their rear side, and has a central horizontal wall 12*b* and upper and lower vertical side walls 12*c* serving concurrently as partitioning walls, the wall 12*b* and the side walls 12*c* defining spaces in which the respective terminal accommodation chambers 13 are formed. And, within the terminal accommodation chambers 13 there are accommodated the female terminals 14. Also, on both sides and center of each of upper and lower surfaces of the box portion 12*a* there are integrally projectively formed engaging pawls (separate engaging portions) 15 respectively and, on the front end at the center of both sides thereof, there are integrally projectively formed flange portions 16 respectively. It is to be noted that at the positions of a front wall of the box portion 12*a* opposed to the respective terminal accommodation chambers 13 there are formed rectangular insertion holes 12*d* through which there are inserted male terminals of a mated connector not illustrated. Further, a pair of pressure contact blades 14*b*, 14*b* are formed in each of both side plate portions at a rear portion of a box portion 14*a* of each female terminal 14 by being bent therefrom.

As illustrated in FIGS. 3 to 5, the outer housing 17 is made into a double-walled box which is constituted by a substantially square-cylindrical inner wall portion 17*a*, a substantially square-cylindrical outer wall 17*b* portion 17*b* enclosing the inner wall portion 17*a*, and a bottom wall portion (one wall portion) connecting the inner and outer wall portions 17*a*, 17*b* and whose front surface side is open. The bottom wall portion 17*c* is thick-walled at its center. In the portions of a front side of the thick-walled portion opposed to the respective terminal accommodation chambers 13, there are respectively formed rubber plug accommodation recessed portions 19 each of which is large in diameter and circular in cross section and into each of which there is accommodated by, for example, forced insertion a waterproof rubber plug 18 which is formed in a insertion hole 18*b*. On a rear side of the thick-walled portion there are respectively formed electric wire insertion holes 21 each of which is small in diameter and circular in cross section and into and through each of which there is passed an electric wire so that the insertion hole 21 may be communicated with a corresponding one of the rubber plug accommodation recessed portions 19. The waterproof rubber plug 18 is made into a substantially cylindrical configuration whose inner and outer circumferential surfaces are each in the form of concavities and convexities, whereby the electric wire 20 is closely passed through the interior thereof.

Also, on both sides of each of respective front portions of upper and lower walls of the inner wall portion 17*a* of the outer housing 17 there are respectively formed rectangular engaging holes (engaging hole portions) 22 with and from which there are engaged and disengaged the engaging pawls 15 on both sides of each of the upper and lower surfaces of the box portion 12*a* of the inner housing 12. At the center on the front side of each of the upper and lower walls of the inner wall portion 17*a* there is formed a rectangular and elongate engaging hole (engaging portion) 23 with and from which there is engaged and disengaged the engaging pawl 15 at the center of each of the upper and lower surfaces of the box portion 12*a* of the inner housing 12. At the large-depth portion on an outer surface side of the inner wall portion 17*a* of the outer housing 17 there is integrally projectively formed a "V"-shaped packing receiving portion 25 that receives therein an annular rubber-made waterproof packing 24. It is to be noted that in the portions, opposed to the respective engaging holes 22, 23, of each of front edges on the inner surface side of the inner wall portion 17*a* of the outer housing 17 there are respectively formed tapered surfaces 26. Also, on a front side of each of the upper and lower walls of the outer wall portion 17*b* of the outer housing 17 there is formed an engaging hole (engaging portion) 27 with and from which there is engaged and disengaged a flexible engaging arm of a mated connector not illustrated.

As illustrated in FIGS. 3 to 5, the spacer 28 is made into a box which is constituted by a substantially square-cylindrical trunk portion 28*a* that is fitted onto the inner surface side of the inner wall portion 17*a* of the outer housing 17, a substantially square-cylindrical flange portion 28*b* that is integrally formed in such a way as to be bent rearward from a front end of the trunk portion 28*a* and that is fitted onto the outer surface side of the inner wall portion 17*a* of the outer housing 17, and a bottom wall portion (one wall portion) 28*c* of the trunk portion 28*a* and whose front surface side is open.

And, the box portion 12*a* of the inner housing 12 is fitted into the trunk portion 28*a* of the spacer 28. On the inner surface of each of the upper and lower walls of the trunk portion 28*a* of the spacer 28 there are integrally projectively formed rib-shaped terminal fall preventing projections 29 for retaining a rear end edge of the box portion 12*a* of the inner housing 12 and rear end edges of the box portions 14*a* of the female terminals 14 accommodated in the respective terminal accommodation chambers 13.

In the portions, opposed to the engaging pawls 15 and flange portions 16 of the inner housing 12, of a front side of the connecting portion between the trunk portion 28*a* and the flange portion 28*b* of the spacer 28 there are formed notched portions 30, 31 respectively. On the outer surface side of each of the upper and lower walls of the trunk portion 28*a* of the spacer 28 between the notched portions 30, 30 on the upper and lower sides there are integrally projectively formed engaging pawls (other engaging pawls) 32 engaged with and disengaged from the respective engaging holes 23 of the outer housing 17. Further, forward end portions of the flange portions 28*b* of the spacer 28 retain the packing 24 retained on the packing receiving portions 25 of the inner wall portion 17*a* of the outer housing 17 at the time when fitted into the outer housing 17.

Also, at the positions, opposed to the respective electric wire insertion-through holes 21 of the outer housing 17, of the bottom wall portion 28*c* of the spacer 28 there are formed electric wire insertion-through holes 33. Also, the bottom wall portion 28*c* of the spacer 28 retains the rubber plugs 18 inserted into the respective plug accommodation recessed portions 19 of the bottom wall portion 17*c* of the outer housing 17 when having been fitted into the outer housing 17. And, as illustrated in FIG. 3, the respective electric wires 20 that have been passed through the respective electric wire insertion-through holes 21 of the outer housing 17, respective rubber plugs 18 and respective electric wire insertion-through holes 33 of the spacer 33 are each connected, by pressure contact, between the pair of pressure contact blades 14*b*, 14*b* of a corresponding one of the respective female terminals 14 accommodated within the respective terminal accommodation chambers 13 of the inner housing 12. And, the terminal accommodation chambers 13 and their respective electric wires 20 are respectively sealed by the respective rubber plugs 18 and packing 24.

Figure 9A:
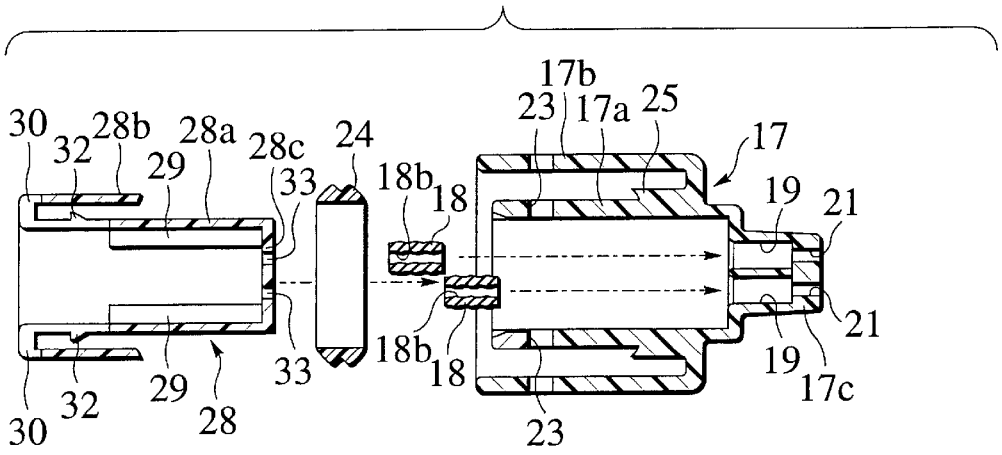
FIG. 9A is a sectional view illustrating a state of the waterproof connector prior to assembly thereof.

When assembling the waterproof connector 10 according to this embodiment, as illustrated in FIG. 9A, the rubber plugs 18 are respectively inserted and set, from the interfitting direction of the connector housing, into the rubber plug accommodation recessed portions 19 inside the bottom wall portion 17*c* of the outer housing 17 forming the outer side of the connector housing 11. Then, the packing 24 is inserted and set in the packing receiving portion 25 of the inner wall portion 17*a* of the outer housing 17.

Figure 9B:
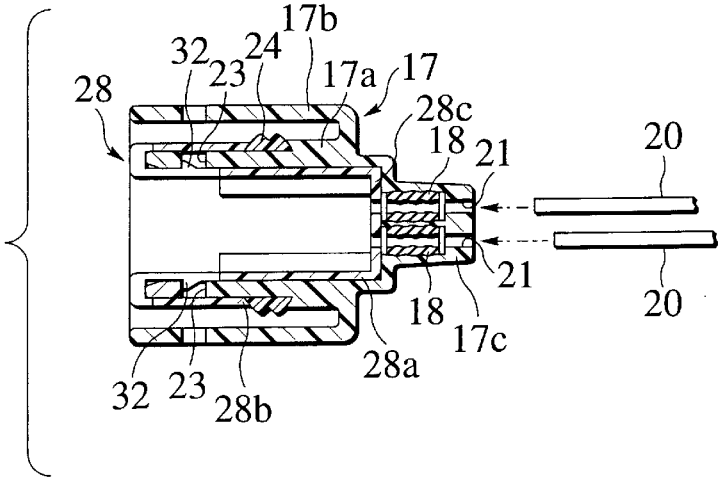
FIG. 9B is a sectional view illustrating a state where a spacer has been fitted into an outer housing of the waterproof connector.

Thereafter, as illustrated in FIG. 9B, the trunk portion 28*a* of the spacer 28 is fitted into the inner wall portion 17*a* of the outer housing 17, whereby the respective engaging pawls 32 of the trunk portion 28*a* of the spacer 28 are engaged with their corresponding holes 23 of the inner wall portion 17*a* of the outer housing 17. As a result of the engagement of the respective engaging pawls 32 of the trunk portion 28*a* of the spacer 28 with their corresponding engaging holes 23 of the inner wall portion 17*a* of the outer housing 17, the respective rubber plugs 18 are prevented from being drawn off by the bottom wall portion 17*c* of the outer housing 17 and simultaneously the packing 24 is prevented from being drawn off by an inclined forward end of the flange portion 28*b* of the spacer 28, with the result that the waterproofness of the connector housing as a whole can be enhanced up to a level one step higher.

Figure 9C:
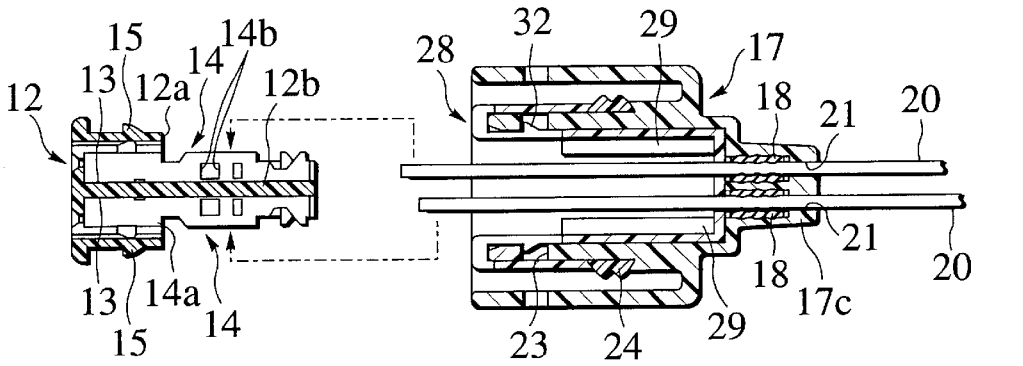
FIG. 9C is a sectional view illustrating a state where electric wires have been passed through the outer housing and spacer.
Figure 9D:
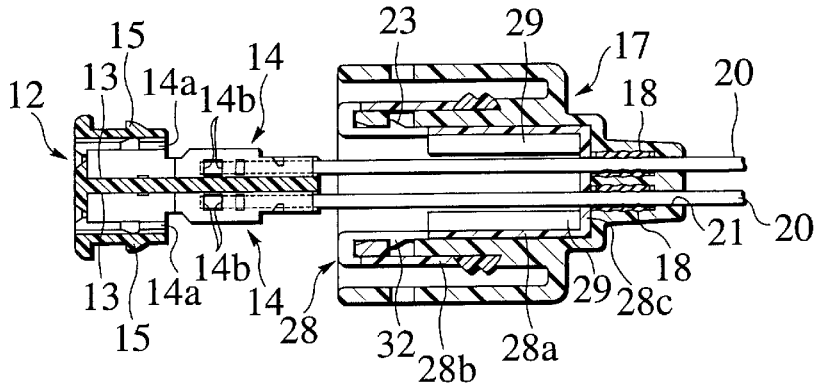
FIG. 9D is a sectional view illustrating a state where the electric wires have been connected to terminals accommodated in the terminal accommodation chambers of an inner housing.

Next, as illustrated in FIG. 9*c*, the electric wires 20 are passed from the electric wire insertion-through holes 21 of the bottom wall portion 17*c* of the outer housing 17, into and through, holes 18*b* (FIG. 9A) of the respective rubberplugs 18 andelectric wire insertion-through holes 33 of the bottom wall portion 28*c* of the spacer 28, from the outside. Next, as illustrated in FIG. 9D, each of the electric wires 20 is connected by pressure contact to the paired pressure contact blades 14*b*, 14*b* of the female terminal 14 accommodated within its corresponding terminal accommodation chamber 13 of the inner housing 12 forming the inner side of the connector housing 11.

Figure 9E:
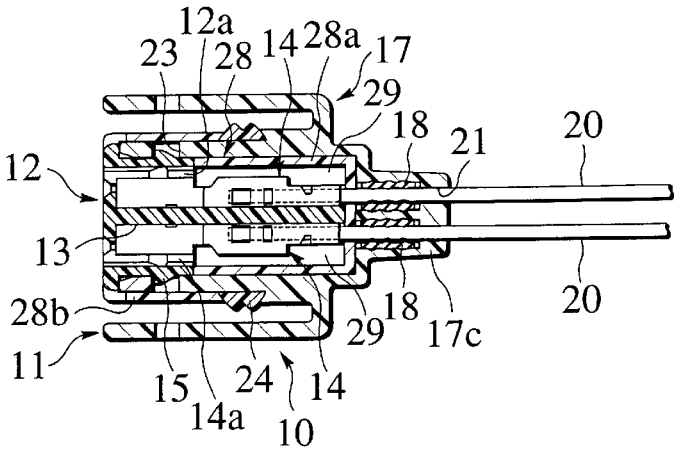
FIG. 9E is a sectional view illustrating a state where the assembly of the waterproof connector is completed.

Next, as illustrated in FIG. 9E, the inner housing 12 is fitted into the trunk portion 28*a* of the spacer 28 to thereby bring the respective engaging pawls 15 of the box portion 12*a* of the inner housing 12 into engagement with their corresponding respective engaging holes 23 of the inner wall portion 17*a* of the outer housing 17. Thus, the assembling of the waterproof connector 10 is completed. In this connection, since the rear end edge of the box portion 12*a* of the inner housing 12 and the rear end edges of the box portions 14*a* of the respective female terminals 14 accommodated within their corresponding terminal accommodation chambers 13 are locked by the respective projections 29 projected on the inner surfaces of the upper and lower walls of the trunk portion 28*a* of the spacer 28 and in addition no deformation of the respective projections 29 to the outside does not occur, the draw-off of the female terminals 14 from the respective terminal accommodation chambers 13 are reliably prevented. In addition, since the retention of the respective female terminals 14 and the retention of the respective rubber plugs 18 can simultaneously be effected by the spacer 28, there is no need to use an exclusive parts item for preventing the draw-off of the rubber plug and it is possible to reduce the number of the constituent parts used and thereby reduce the cost involved. Further, since the spacer 28 is doubly locked by the engagement of the respective engagement pawls 32 of the spacer 28 itself as well as by the engagement of the respective engagement pawls 15 of the inner housing 12 with the engaging pawls 23 of the outer housing 17, it is possible to reliably prevent the disengagement of the respective rubber plugs 18 and packing 24 and thereby enhance the reliability on the waterproofness up to a level one step higher.

Since the female terminals 14 can be reliably retained by the spacer 28 interposed between the inner housing 12 and outer housing 17 in the above-described way, it is possible to increase the force of retaining the female terminals 14 and thereby enhance the reliability on the retention thereof. As a result of this, it is possible to assemble smoothly a multipolar and small-in-size waterproof connector 10 having an excellent level of terminal retaining force and waterproofness in a simple way, in a short time and at a low cost. And, after the assembling of the waterproof connector 10 is completed, for example, even when the electric wires 20 are pulled, it is possible to reliably retain the female terminals 14 in the terminal accommodation chambers 13 through the spacer 28.

Also, since as illustrated in FIG. 5 the diameter L of the rubber plug accommodation recessed portion 19 formed in the bottom wall portion 17*c* of the outer housing 17 can be minimized without being influenced by the size of the terminal accommodation chamber 13 of the inner housing 12, it is possible to make the terminal-to-terminal's pitch X illustrated in FIG. 6 smaller than that in the conventional waterproof connector and thereby miniaturize the multipolar connector housing 11. Further, since as illustrated in FIG. 5 the rubber plug 18 is more completely enclosed by the rubber plug accommodation recessed portion 19 of the bottom wall portion 17*c* of the outer housing 17 and so is not exposed to a side that is outer than the bottom wall portion 17*c*, it is possible to reliably prevent a decrease in the sealing performance of the rubber plug 18 due to an external force and thereby enhance the reliability on the waterproofness of the entire waterproof connector 10 up to a level that is one step higher.

Figure 10A:
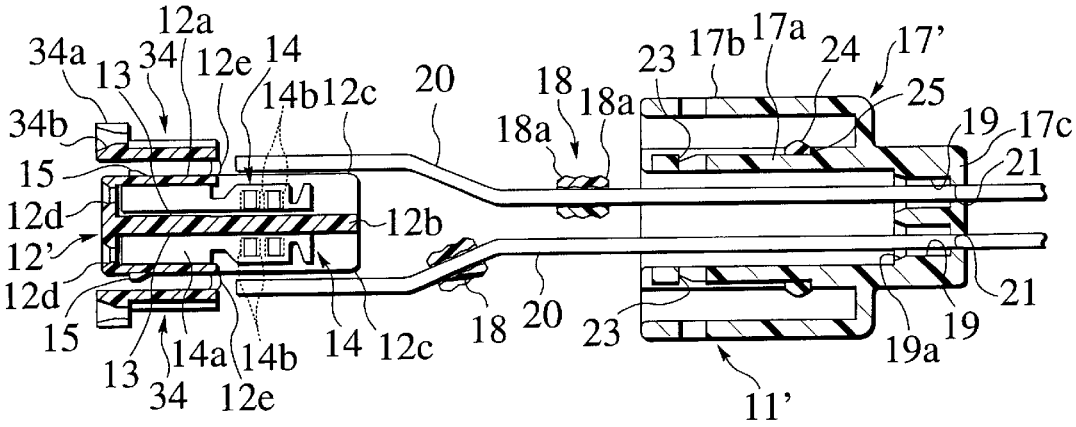
FIG. 10A is a sectional view illustrating a state where rubber plugs have been inserted over electric wires throughout the rubber plugs prior to assembly of a waterproof connector according to another embodiment of the present invention.
Figure 10B:
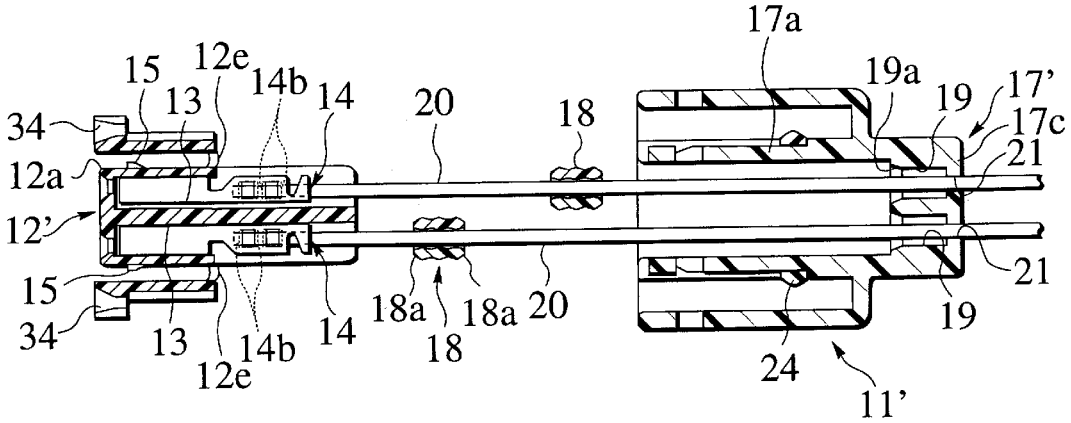
FIG. 10B is a sectional view illustrating a state where the electric wires have been connected to terminals accommodated in the terminal accommodation chambers of an inner housing.
Figure 10C:
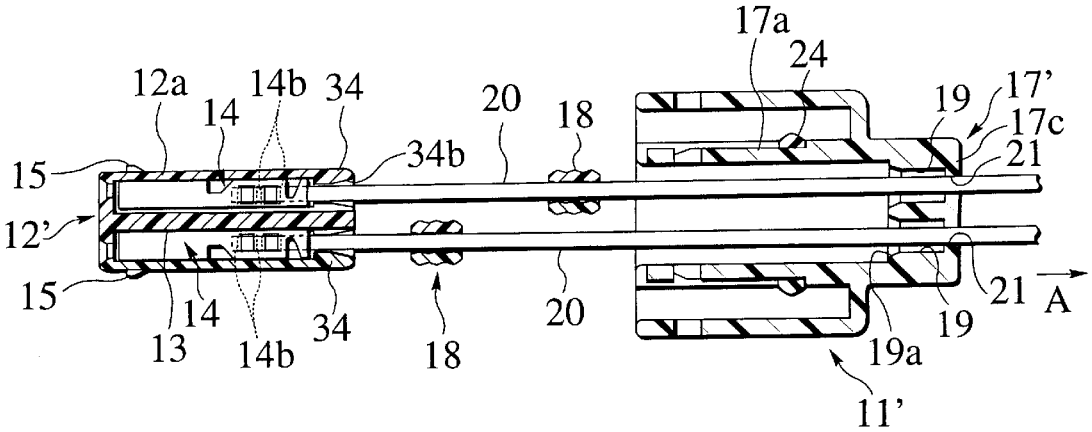
FIG. 10C is a sectional view illustrating a state where the electric wires having the terminals connected thereto are in the state of being pulled in an outward direction of an outer housing.
Figure 10D:
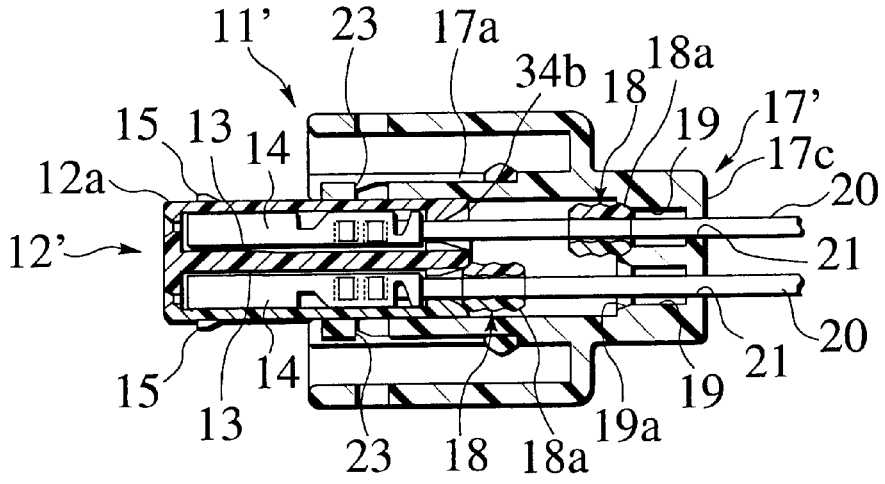
FIG. 10D is a sectional view illustrating a state in the course of interfitting between the inner housing and outer housing.
Figure 10E:
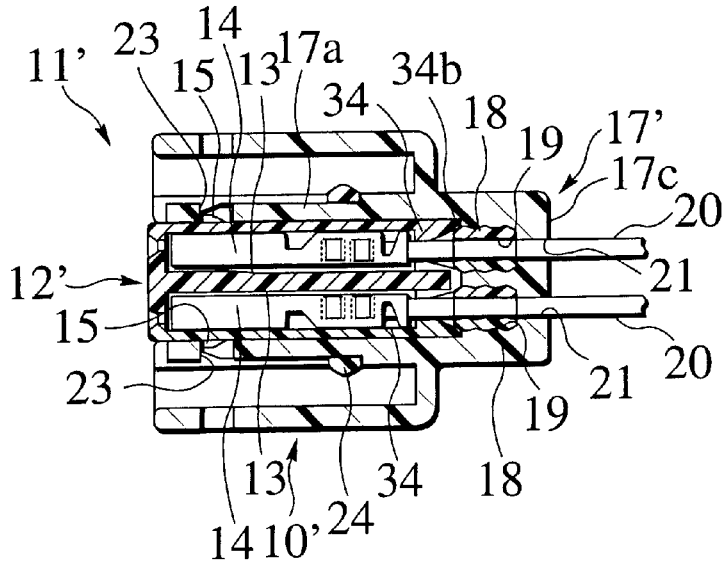
FIG. 10E is a sectional view illustrating a state where the assembly of the waterproof connector is completed.
Figure 11A:
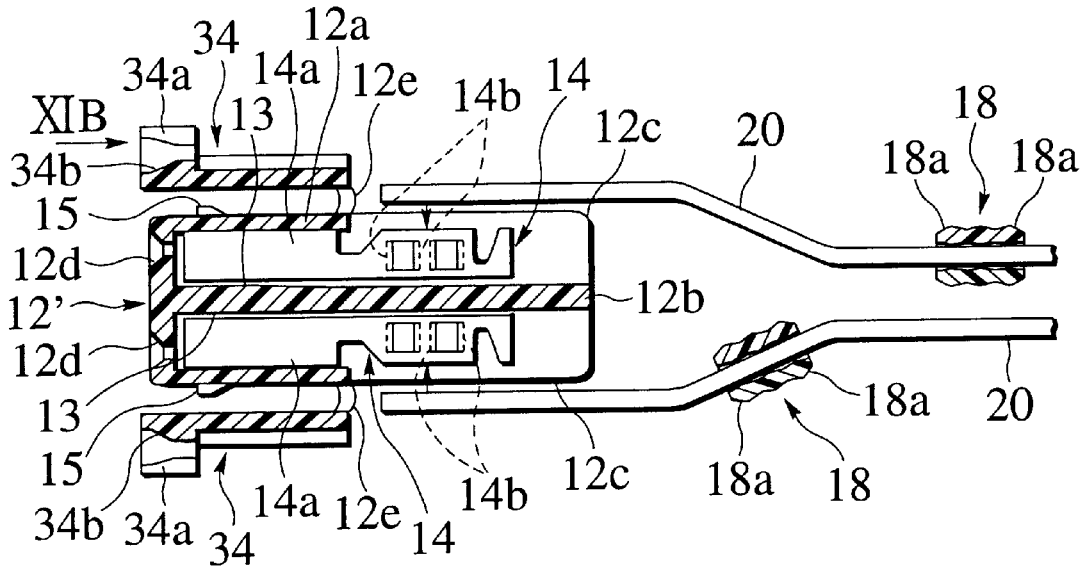
FIG. 11A is an enlarged sectional view illustrating a main part of the waterproof connector according to said another embodiment prior to the connection of the electric wires to this waterproof connector.
Figure 11B:
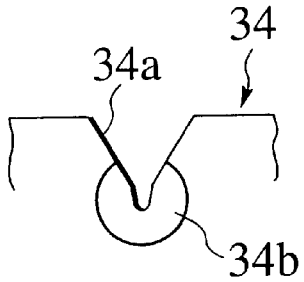
FIG. 11B is an explanatory view of the main part of FIG. 11A as taken from a direction indicated by an arrow XIB.

FIG. 10A is a sectional view illustrating a state where rubber plugs have been inserted over electric wires throughout the rubber plugs prior to assembly of a waterproof connector according to another embodiment of the present invention; FIG. 10B is a sectional view illustrating a state where the electric wires have been connected to terminals accommodated in the terminal accommodation chambers of an inner housing; FIG. 10C is a sectional view illustrating a state where the electric wires having the terminals connected thereto are in the state of being pulled in an outward direction of an outer housing; FIG. 10D is a sectional view illustrating a state in the course of interfitting between the inner housing and outer housing; and FIG. 10E is a sectional view illustrating a state where the assembly of the waterproof connector is completed; FIG. 11A is an enlarged sectional view illustrating a main part of the waterproof connector prior to the connection of the electric wires to this waterproof connector; and FIG. 11B is an explanatory view of the main part of FIG. 11A as taken from a direction indicated by an arrow XIB; and FIG. 12 is an enlarged sectional view illustrating a state in the course of interfitting of the waterproof connector.

Figure 12:
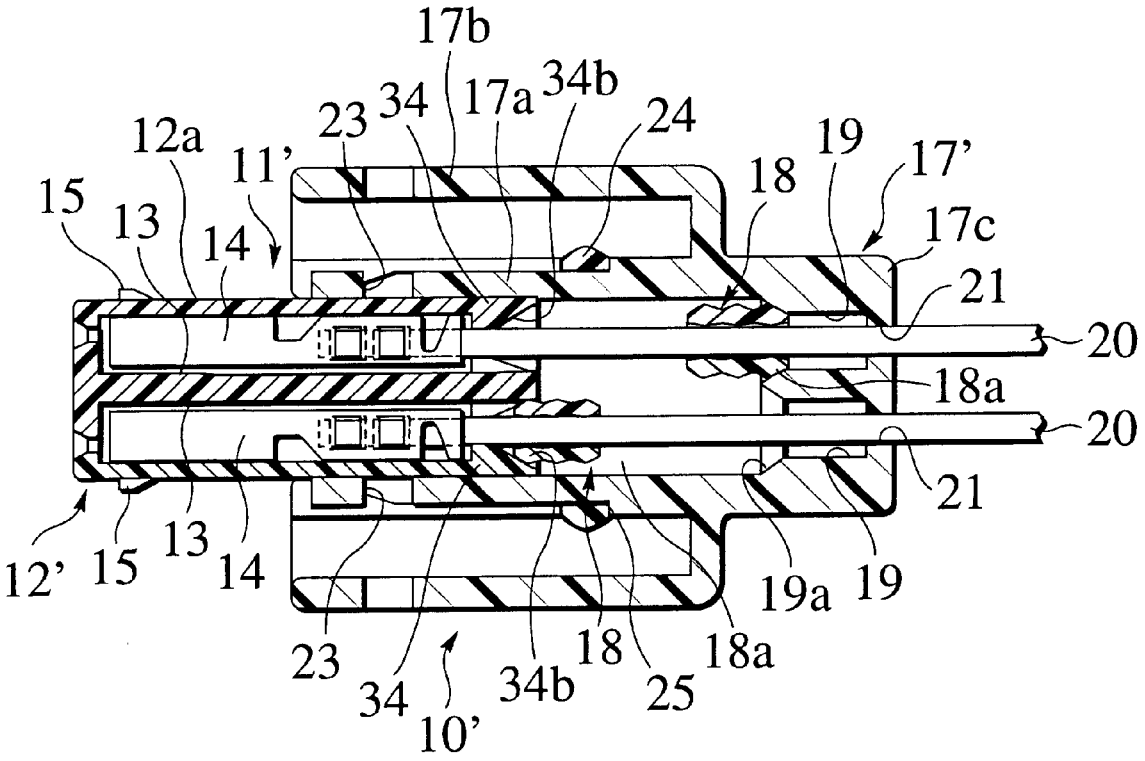
FIG. 12 is an enlarged sectional view illustrating a state in the course of interfitting between the inner housing and outer housing of the waterproof connector according to said another embodiment.

As illustrated in FIGS. 10E and 12, a connector housing 11' of a waterproof connector 10' according to another embodiment of the present invention is constituted by an inner housing 12' having integrally formed therein a plurality of terminal accommodation chambers 13 and made of synthetic resin, and an outer housing 17' into which the inner housing 12' is fitted and which is made of synthetic resin. On rear ends of upper and lower surfaces of a box portion 12*a* of the inner housing 12' there are respectively integrally formed through hinge portions 12*e* a pair of upper and lower pressure contact covers (covers) 34, 34. The respective pressure contact blade covers 34 close upper and lower opening portions at a rear side of the box portion 12*a* of the inner housing 12', thereby protecting female terminals (terminals) accommodated in the respective terminal accommodation chambers 13 of the inner housing 12. Further, as illustrated in FIGS. 11A and 11B, in protruding portions of rear ends of the respective pressure contact blade covers 34 there are respectively formed "V"-shaped slits 34*a* through which corresponding electric wires 20 are inserted, as well as conical recessed portions (rubber plug guiding portions) 34*b* for guiding rubber plugs 18 to their prescribed positions.

Also, as illustrated in FIG. 11A, on both end sides of each rubber plug 18 there are respectively formed conical surfaces (tapered surfaces) 18*a* and 18*a*, whereby both ends thereof are each made conical. Further, on inlet sides of rubber plug accommodation recessed portions 19 on an inner side of a bottom wall portion (one wall portion) 17*c* of the outer housing 17' there are formed inverse-conical surfaces (tapered surfaces) 19*a*. It is to be noted that since other constructions are the same as those of the waterproof connector 10 according to the above-described embodiment, the same constituent portions as those thereof are denoted by like reference numerals and an explanation thereof is omitted. Further, since the waterproof connector 10' of this another embodiment is constructed such that after the electric wires 20 have been passed through the rubber plugs 18, these electric wires 20 are each connected by pressure contact to a pair of pressure contact blades 14*b*, 14*b* of a corresponding one of the female terminals 14 accommodated in the respective terminal accommodation chambers 13 of the inner housing 12', the spacer 28 of the above-described embodiment becomes unnecessary.

In a case where assembling the waterproof connector 10' of this another embodiment, as illustrated in FIG. 10A, the packing 24 is inserted into the packing receiving portion 25 of the inner wall portion 17*a* of the outer housing 17' forming the outer side of the connector housing 11' and this packing 24 is thereby set beforehand. And, after passing the electric wires 20 into a plurality of the electric wire insertion-through holes 21 of the bottom wall portion 17*c* of the outer housing 17' from outside the same, the rubber plugs 18 are inserted over the electric wires 20 to thereby set the electric wires 20 at the positions (the positions for connection thereof to be made by pressure contact) that oppose the respective female terminals 14 accommodated in a plurality of the terminal accommodation chambers 13 of the inner housing 12' forming the inner side of the connector housing 11'.

Next, as illustrated in FIG. 10B, the respective electric wires 20 are each connected by pressure contact to the pair of pressure contact blades 14*b*, 14*b* of the female terminal 14 accommodated in a corresponding one of the terminal accommodation chambers 13 of the inner housing 12'. And, as illustrated in FIG. 10C, after closing the respective upper and lower opening portions on the rear side of the box portion 12*a* of the inner housing 12' by the pair of upper and lower pressure contact blade covers 34, 34 connected to the inner housing 12' through the hinge portions 12*e*, the respective electric wires 20 are pulled in a direction A to the outside of the outer housing 17' to thereby gradually fit the inner housing 12' into the outer housing 17'. At this time, as illustrated in FIG. 10D, by being guided by the respective electric wires 20 themselves as well as by the inverse-conical surfaces 19*a* on the inlet side of the respective rubber plug accommodation recessed portions 19 of the bottom wall portion 17*c* of the outer housing 17' and the conical surfaces 18*a* of the rubber plugs 18, the rubber plugs 18 are inserted up to prescribed positions within the respective rubber plug accommodation recessed portions 19 and thereby set therein, respectively.

Next, as illustrated in FIG. 10E, the inner housing 12' is completely fitted into the outer housing 17' to thereby bring the respective engaging pawls 15 of the box portion 12*a* of the inner housing 12' into engagement with their corresponding respective engaging holes 23 of the inner wall portion 17*a* of the outer housing 17'. The assembling of the waterproof connector 10' is thereby completed. Since at this time the respective rubber plugs 18 are guided into the corresponding respective rubber plug accommodation recessed portions 19 of the outer housing 17', and prevented from being drawn of f therefrom, by the corresponding conical recessed portions 34*b* of the pressure contact blade covers 34, the sealing performance (waterproofness) of the entire connector housing is reliably ensured. Also, the fall-off of the female terminals 14 from the respective terminal accommodation chambers 13 is reliably prevented by the respective pressure contact blade covers 34. In addition, since the use of the spacer 28 becomes unnecessary, there is no need to use an exclusive parts item for preventing the draw-off of the rubber plugs, with the result that the number of the constituent parts used is reduced and the cost of the waterproof as a whole is also reduced one step more greatly.

In this way, when inserting and setting the respective rubber plugs 18 in their respective rubber plug accommodation recessed portions 19 of the outer housing 17', the conical recessed portions 34*b* of the pressure contact blade covers 34 of the inner housing 12', the conical surfaces 18*a* of the rubber plugs 18, the inverse-conical surfaces 19*a* on the inlet side of the rubber plug accommodation recessed portions 19 of the outer housing 17', and the electric wires 20 serve as guides. As a result, the rubber plugs 18 can be reliably accommodated into their respective rubber plug accommodation recessed portions 19 of the outer housing 17' in a simple way and, simultaneously with the fitting of the inner housing 12' into the outer housing 17', the rubber plugs 18 can be reliably accommodated in their corresponding respective accommodation recessed portions 19 of the outer housing 17'. Therefore, the assemblability of the waterproof connector 10' and the reliability on the waterproofness effected with the use of the respective rubber plugs 18 are enhanced one step more greatly.

Additionally, although according to the above-described respective embodiments the electric wires have been explained as being connected to the-pressure contact terminals by a pressure contact technique, the terminals are not limited to the pressure contact terminals. The above-described respective embodiments can of course be applied also to a case where connecting electric wires to pressure bond terminals by a pressure bond technique.

While preferred embodiments of the present invention have been described using specific terms, such description is for illustrative purposes, and it is to be understood that changes and variations may be made without departing from the spirit or scope of the following claims.

What is claimed is:

1. A waterproof connector, comprising:

an inner housing formed with terminal accommodation chambers in which terminals to which electric wires are connect are accommodated;

rubber plugs for sealing the electric wires, the rubber plugs having formed therein holes through which the electric wires are inserted and passed; and an outer housing into which the inner housing is fitted, a wall portion of the outer housing opposing to the terminal accommodation chambers being formed with electric wire insertion and passing holes through which the electric wires are inserted and passed, an inside portion of the wall portion of the outer housing corresponding to the electric wire insertion and passing holes being formed with rubber plug accommodation recessed portions for accommodating therein the rubber plugs, wherein the electric wires that have been inserted and passed through the electric wire insertion and passing holes and the holes of the rubber plugs are connected to the terminals which are accommodated in the terminal accommodation chambers.

2. A waterproof connector according to claim 1, wherein a tapered surface is formed on an inlet side of the rubber plug accommodation recessed portion;

a tapered surface is formed on each side of the rubber plug; and a rubber plug guiding portion to guide the rubber plug is formed at a position of the inner housing corresponding to the tapered surface of the rubber plug.

3. A method of assembling a waterproof connector, comprising the steps of:

accommodating terminals to be connected to electric wires in terminal accommodation chambers formed in an inner housing;

inserting and setting rubber plugs for sealing the electric wires in rubber plug accommodation recessed portions formed in an inside portion of a wall portion of an outer housing;

inserting and passing the electric wires into and through electric wire insertion and passing holes formed in the outer housing at positions of the wall portion opposed to the terminal accommodation chambers;

inserting and passing the electric wires which are passing through the electric wire insertion and passing holes into and through holes formed in the rubber plugs;

connecting the electric wires passed through the holes of the rubber plugs to the terminals accommodated in the terminal accommodation chambers; and fitting the inner housing into the outer housing.

4. A method of assembling a waterproof connector, comprising the steps of:

accommodating terminals to be connected to electric wires in terminal accommodation chambers formed in an inner housing;

inserting and passing the electric wires into and through electric wire insertion and passing holes formed at positions of a wall portion of an outer housing opposing to the terminal accommodation chambers from outside the outer housing to inside the outer housing;

inserting and passing the electric wires which are passing through the electric wire insertion and passing holes into and through holes formed in rubber plugs;

connecting the electric wires passed through the holes of the rubber plugs to the terminals accommodated in the terminal accommodation chambers;

drawing the electric wires in a direction opposite to a direction in which the electric wires are inserted and thereby inserting and setting the rubber plugs in rubber plug accommodation recessed portions formed inside the wall portion of the outer housing; and fitting the inner housing into the outer housing.

* * * * *

UNITED STATES PATENT AND TRADEMARK OFFICE

CERTIFICATE OF CORRECTION

PATENT NO. : 6,179,657
DATED : January 30, 2001
INVENTOR(S) : Takao MURAKAMI et al.

It is certified that error appears in the above-identified patent and that said Letters Patent is hereby corrected as shown below:

Claim 1, column 10, line 43, "connect" should read --to be connected--.

Signed and Sealed this

Fifth Day of June, 2001

*Attest:*

*Attesting Officer*

Nicholas P. Godici

NICHOLAS P. GODICI

*Acting Director of the United States Patent and Trademark Office*